US007651299B2

(12) United States Patent
Huang

(10) Patent No.: US 7,651,299 B2
(45) Date of Patent: Jan. 26, 2010

(54) ANCHORING CABLE WITH NEW STRUCTURE AND MATERIALS TO BUFFER STRESS AND RESTORE ELASTICITY

(76) Inventor: Yun Peng Huang, 19451 Greenwood Dr., APT#1, Cupertino City, CA (US) 95014

( * ) Notice: Subject to any disclaimer, the term of this patent is extended or adjusted under 35 U.S.C. 154(b) by 0 days.

(21) Appl. No.: 12/069,974

(22) Filed: Feb. 13, 2008

(65) Prior Publication Data

US 2009/0202306 A1 Aug. 13, 2009

(51) Int. Cl.
*B63B 21/00* (2006.01)

(52) U.S. Cl. ..... 405/224; 114/293

(58) Field of Classification Search ..... 405/224, 405/224.1, 224.2, 224.3, 224.4, 223.1; 114/293
See application file for complete search history.

(56) References Cited

U.S. PATENT DOCUMENTS 4,471,709 A * 9/1984 Chun ..... 114/293
4,813,815 A * 3/1989 McGehee ..... 405/224
5,039,255 A * 8/1991 Salama ..... 405/224
H1246 H * 11/1993 Huffaker et al. ..... 405/223.1
6,899,050 B1 * 5/2005 Huang ..... 114/293

* cited by examiner

*Primary Examiner*—Frederick L Lagman
(74) *Attorney, Agent, or Firm*—Bo-In Lin

(57) ABSTRACT

A new and improved submarine anchoring cable that includes an outer layer that comprises 20% to 80% polyurethane elastomer, 20% to 80% carbon fiber mixed at a certain ratio. The outer layer is compressed to wrap around an aramid fiber or an ultra-high-molecular-weight polyethylene (UHMWPE) fiber and a core of synthetic fiber rope with molecular malleability, e.g., nylon, nylon66, and the polyester rope. The rope is exposed in a form of a loop from both ends of the cable. Each loop has one or multiple layers of sheath made of aramid fiber, Kelvar fiber or UHMWPE fiber wrapping around the rope near a tie on each end to provide extra friction and withstanding strength. One end of the anchor cable is fixed to the offshore platform and the other end is fixed to each anchor to hold on to the offshore platform within a limited area defined by multiple anchors fastened to the offshore platform.

1 Claim, 24 Drawing Sheets

ANCHORING CABLE WITH NEW STRUCTURE AND MATERIALS TO BUFFER STRESS AND RESTORE ELASTICITY

FIELD OF THE INVENTION

The present invention relates to an anchoring cable and fixtures for anchoring and steadily holding an offshore floating platform or pontoon on or in the water. More particularly, the present invention relates to a flexible anchoring rope and improved cable layer configuration and composition materials of anchoring cable and fixture to provide a good pre-stressed buffer to sustain the tension produced by the tidal currents during the rising and ebb tides and a good resilience to keep the floating platform or pontoon in a certain specific area.

DESCRIPTION OF THE PRIOR ART

Floating platform anchoring cables (also referred to as tethers, cables, tendons, support lines, mooring lines, and the like) are useful for securing floating structures such floating platforms for different kinds of applications in deepwater. Conventional anchoring cables however are limited by their limited strength to withstand the forces imposed on the platforms by the unpredictable tidal waves. Furthermore, conventional cables are further hindered in the applications due to limited life when impacted constantly by the force from the waves. Elasticity fatigues and material failures often cause the anchoring system to fail and unable to consistently and reliably secure the platform in a restricted areas by the anchoring system due to these failures.

There are ever increasing demands for a secure and reliable anchoring system to overcome such problems and limitations. Particularly, for areas with high population density, it is desirable to expand the living space through the development of spaces over the water either in the bays or over the seas. Conventional technologies and methods of using landfill have now been more restricted due to the environmental concerns. Instead, ultra large offshore platforms on the sea for application as harbor or airplane landing field are becoming more popular. Such applications are more favorable because they present less environmental impacts on the coast while keeping away noise and pollution from the land. The ultra-large platform constructed with steel structures provide ample room for human activities and may be useful for container terminals, refinery plants or other types of applications. Recent advances in technologies for platform stability and resistance to seawater corrosion further add to the advantages of applications of the offshore platforms.

Several patents and published patent applications disclose different cables and platform anchoring systems to securely and reliably keep the platform in a restricted offshore area. U.S. Pat. Nos. 6,608,487, 6,899,050, and Patent Applications 20020176747, and 20030010966 disclose anchoring cables and platform anchoring systems to securely maintain the offshore platforms in limited areas. However, when platforms of large size and large areas are required, long-term reliable anchoring cables keeps in taut with secure anchoring attachment fixtures are still required to sustain the waves during the storm while having sufficient reviving and restoring elasticity to have long life cycle of operation without being jeopardized by the elasticity fatigues. In the meantime, it is further required that the cable and anchoring system can also prevent the storm wave to accumulate a huge shock force suddenly loading on some part of the large platform anchoring systems.

Therefore, a need still exists in the art of floating structure securing and anchoring systems to provide new and improved cables and anchoring fixtures such that the above discussed problems and difficulties may be resolved.

SUMMARY OF THE PRESENT INVENTION

It is therefore an aspect of the present invention to provide a new and improved submarine anchoring cable composed of compound polyurethane elastomer to buffer and sustain the impact from tidal waves with great transient fluctuation speed in severe weather conditions for holding a floating platform in a restricted area.

Specifically, another aspect of this invention is to provide a new and improved submarine anchoring cable comprising one layer of compound polyurethane elastomer that includes multiple layers of 20% to 80% polyurethane elastomer, 20% to 80% carbon fiber and aramid fiber or Kelvar fiber or ultra-high-molecular-weight polyethylene (UHMWPE) fiber to provide improved buffer pre-stress for withstanding pull from tidal waves. Furthermore, the cable has improved restoring elasticity for steadily holding the offshore platform.

Another aspect of this invention is to provide a new and improved submarine anchoring cable that includes an outer layer that comprises 20% to 80% polyurethane elastomer, 20% to 80% carbon fiber mixed at a certain ratio. The outer layer is compressed to wrap around an aramid fiber or an ultra-high-molecular-weight polyethylene (UHMWPE) fiber and a core of synthetic fiber rope with molecular malleability, e.g., nylon, nylon66, and the polyester rope. The rope is exposed in a form of a loop from both ends of the cable. Each loop has one or multiple layers of sheath made of aramid fiber, Kelvar fiber or UHMWPE fiber wrapping around the rope near a tie on each end to provide extra friction and withstanding strength. One end of the anchor cable is fixed to the offshore platform and the other end is fixed to each anchor to hold on to the offshore platform within a limited area defined by multiple anchors fastened to the offshore platform.

Briefly, in a preferred embodiment, the present invention discloses a floating structure anchoring system. The system includes an anchoring cable having an extension-lock device includes rubber ropes to allow for stretching longer to absorb pulling force asserted thereon and an extension-locking loop have a longer length than the rubber ropes for restricting an extended length of the extension-lock device whereby a sudden pulling force is absorbed by the rubber ropes and a distance of movement from the sudden pulling force is restricted by the safety-locking loop.

These and other objects and advantages of the present invention will no doubt become obvious to those of ordinary skill in the art after having read the following detailed description of the preferred embodiment, which is illustrated in the various drawing figures.

BRIEF DESCRIPTION OF THE DRAWINGS

FIGS. 10 to 24 show another embodiment for implementing in the cables of this invention with an extension-locking device that allows for cable extension while lock the cable with a restricted extension length for securely and reliably holding the offshore structure to the cables wherein details structures are shown in FIGS. 14A to 14H.

DETAILED DESCRIPTION OF THE PREFERRED EMBODIMENT

Figure 1:
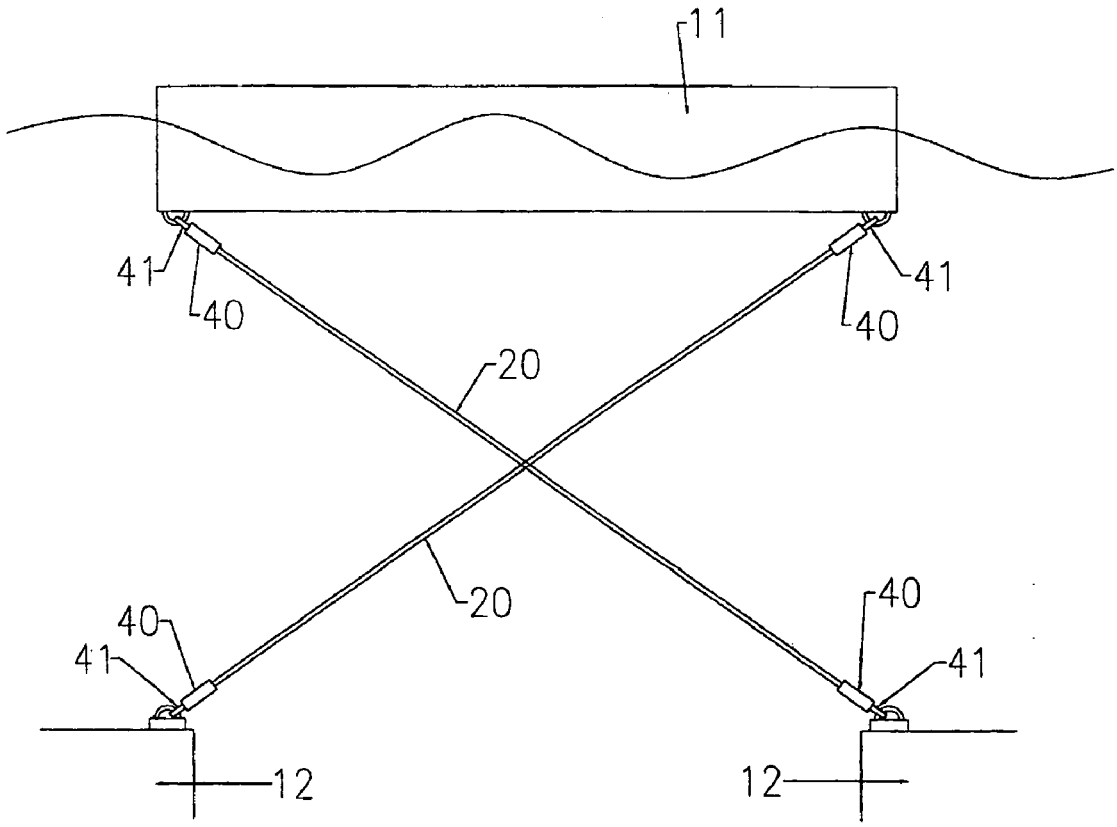
FIG. 1 is a structure diagram for showing platform tied to cables attached to anchoring fixtures for securely and reliably keeping the platform in a restricted area.
Figure 2:
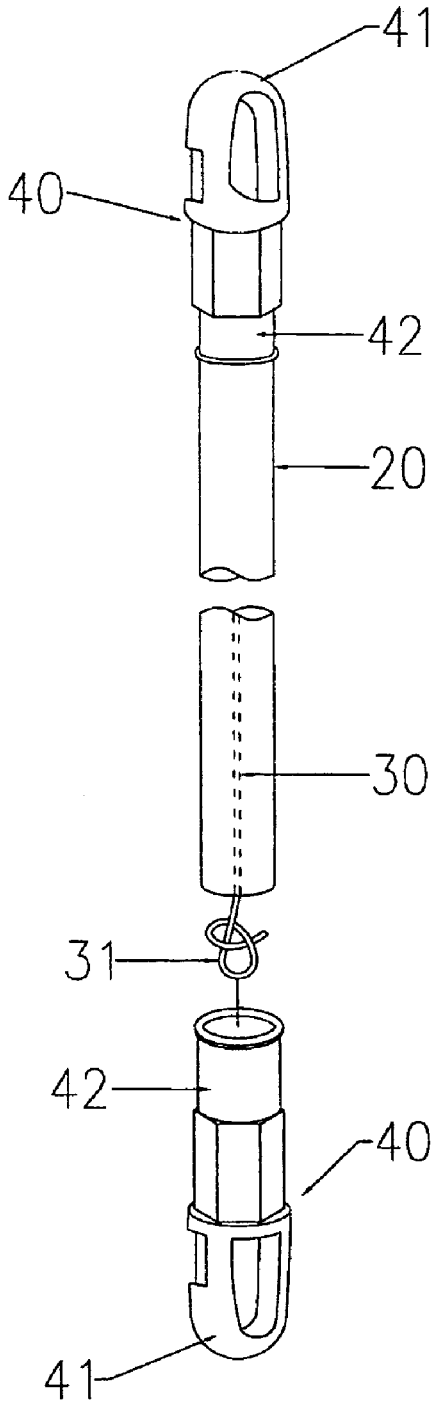
FIG. 2 shows a perspective view to illustrate the structure of a cable and attachment fixture to the cable of this invention.

Referring to FIG. 1 for an anchoring cable 20 holding on to an offshore platform 11 to steadily attached to a submarine anchor 12. The details of layer structure and attachment fixtures are shown in FIGS. 2 to 10. The anchoring cable 20 constitutes a large-sized cable composed of polyurethane elastomer for holding on to an offshore platform 11. The cable 20 includes an outer layer that has multiple layers of polyurethane elastomer and carbon fiber mixed at a certain ratio. The outer layer of the cable 20 is compressed to wrap around an aramid fiber or an ultra-high-molecular-weight polyethylene (UHMWPE) fiber. The cable 20 further includes a core 30 composed of a synthetic fiber with molecular malleability, e.g., nylon, nylon66, and the polyester rope. The core rope 30 is extended on both ends of the cable 20 and exposed and braided in a form as consistent distributed self-locking loop. These self-locking loops are braided in alternative lamination fashion.

One or multiple layers of sheath 32 wraps around the rope 30 near a tie on each end of the extended and exposed rope 30. Each sheath 32 wraps around the tie 31 in alternating braided fashion to tighten up and compressed to increase the strength and friction for withstanding a pulling force imposed on the cable 20 and to the tie 31.

Figure 3:
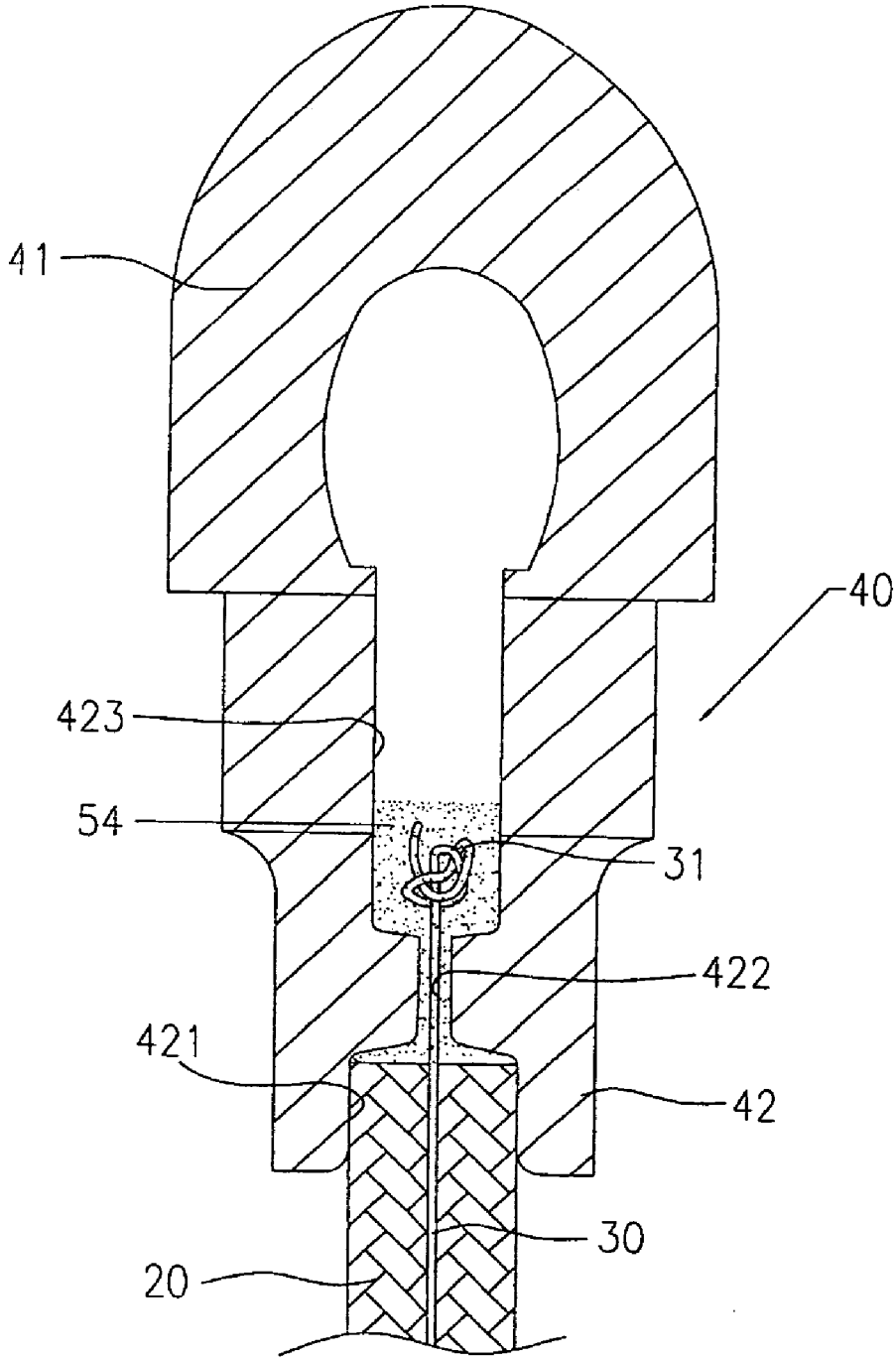
FIG. 3 is a cross sectional view of a fixture to illustrate the attachment configuration of the fixture attached to the cable.

The sheath 32 is made of aramid fiber, Kevlar fiber or UHMWPE fiber, e.g., a commercial product under the brand name of DYNEEMA as a registered trademark by the manufacturer DSM. The UHMWPE fiber, such as DYNEEMA, is heated and vulcanized together with the polyurethane elastomer to produce high friction withstanding strength of the cable. The tie 31 of the loop is fastened to the offshore platform 11 and the other end of the loop is fastened to each anchor or anchor line 12 for the cable 20 to hold the offshore platform 11 steady within a limited range defined by multiple anchors 12 as illustrated in FIG. 3. A large-sized steel karabiner is used to fasten the loop to the offshore platform while the other end of the cable is fastened to each anchor to achieve the same purpose of holding steady the offshore platform.

It is to be noted that the present invention by using one or multiple layers of polyurethane elastomer and carbon fiber wrapping around one or multiple layers of aramid fiber, Kevlar fiber or UHMWPE fiber provides better buffer pre-stress to withstand the strong pull by the rising and falling of tide. The use of connection and latch ends effectively secures the cable for the offshore platform to be held steady within a smaller area and prevents the offshore platform from drifting away due to that the cable is broken by excessively large fluctuation speed of the wave in severe weather conditions such as the strike of typhoon. The core rope for giving excellent malleability provides fast return force for the cable once the external pull disappears.

Figure 4:
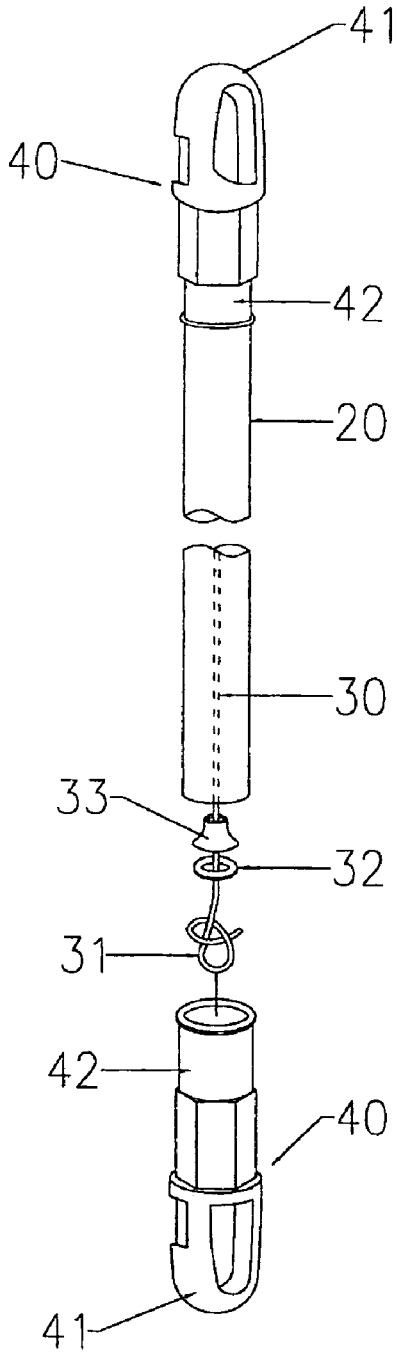
FIG. 4 shows a perspective view to illustrate more details of a cable and the attachment fixture of FIG. 2.
Figure 5:
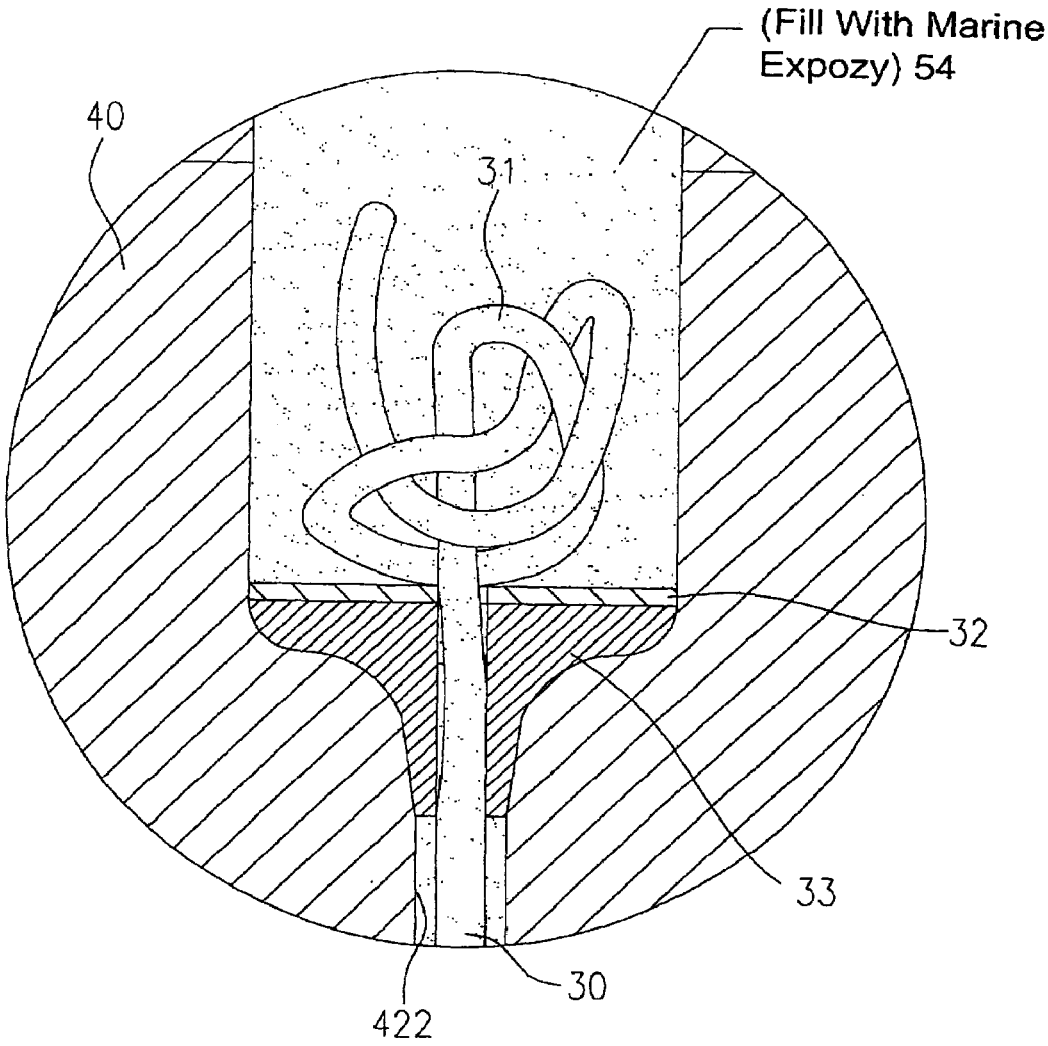
FIG. 5 is an explosive cross sectional view to illustrate the configuration of the cable attached to an anchoring fixture.
Figure 6:
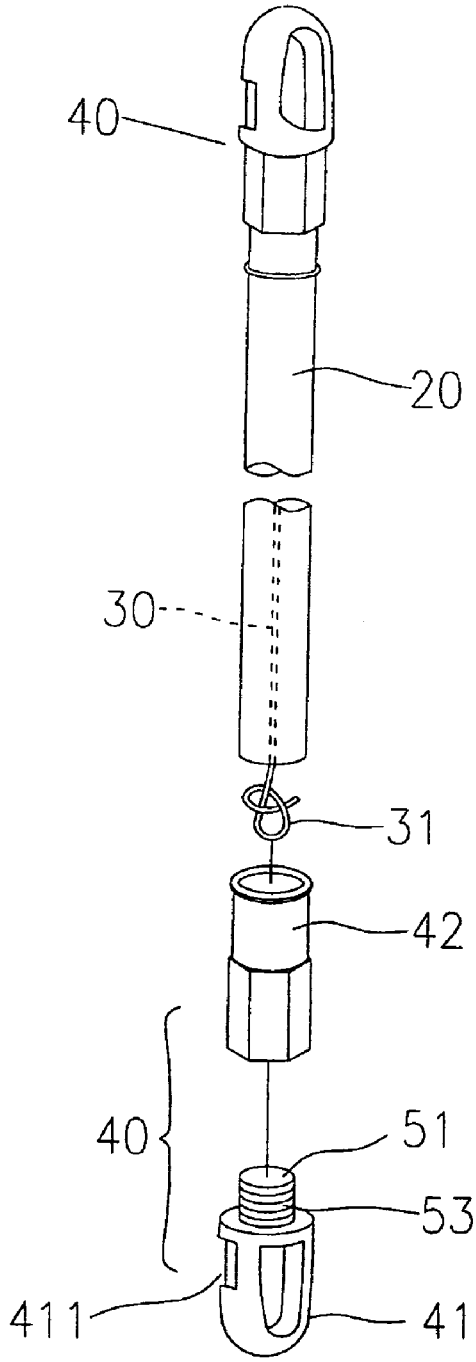
FIG. 6 shows a cross sectional view for illustrating the screw configuration of the cable attachment fixture.

The elastically extendable and restorable cable 20 is attached to the platform and the submarine anchor 12 through a fixture apparatus 40. The fixture apparatus 40 includes a single-body formed attachment end 41 and cable tie-down interface 42. The cable tie-down interface 42 includes an opening 421 that allows the entire cable 20 to be surrounded by the walls of the opening 421. The tie-down interface further includes a core opening 422 that allows a smaller core 30 to pass through to form a tie 31 in an upper opening having a greater diameter than the core opening 422. The low portion of the upper opening that adapts the tie 31 therein is filled with epoxy 54 to securely maintain the tie 31 to prevent the tie 31 being pulled out from the core opening 422. As shown in FIG. 4, the core 30 first passes through a cone shaped attachment fixture 33 then through the central opening of the sheath 32. The attachment fixture 33 is adapted into the opening of the tie-down interface 42 together with the sheath 32 to keep the core 30 and the tie 31 securely and reliably fixed inside the fixture apparatus 40 as shown in FIG. 3.

Figure 7:
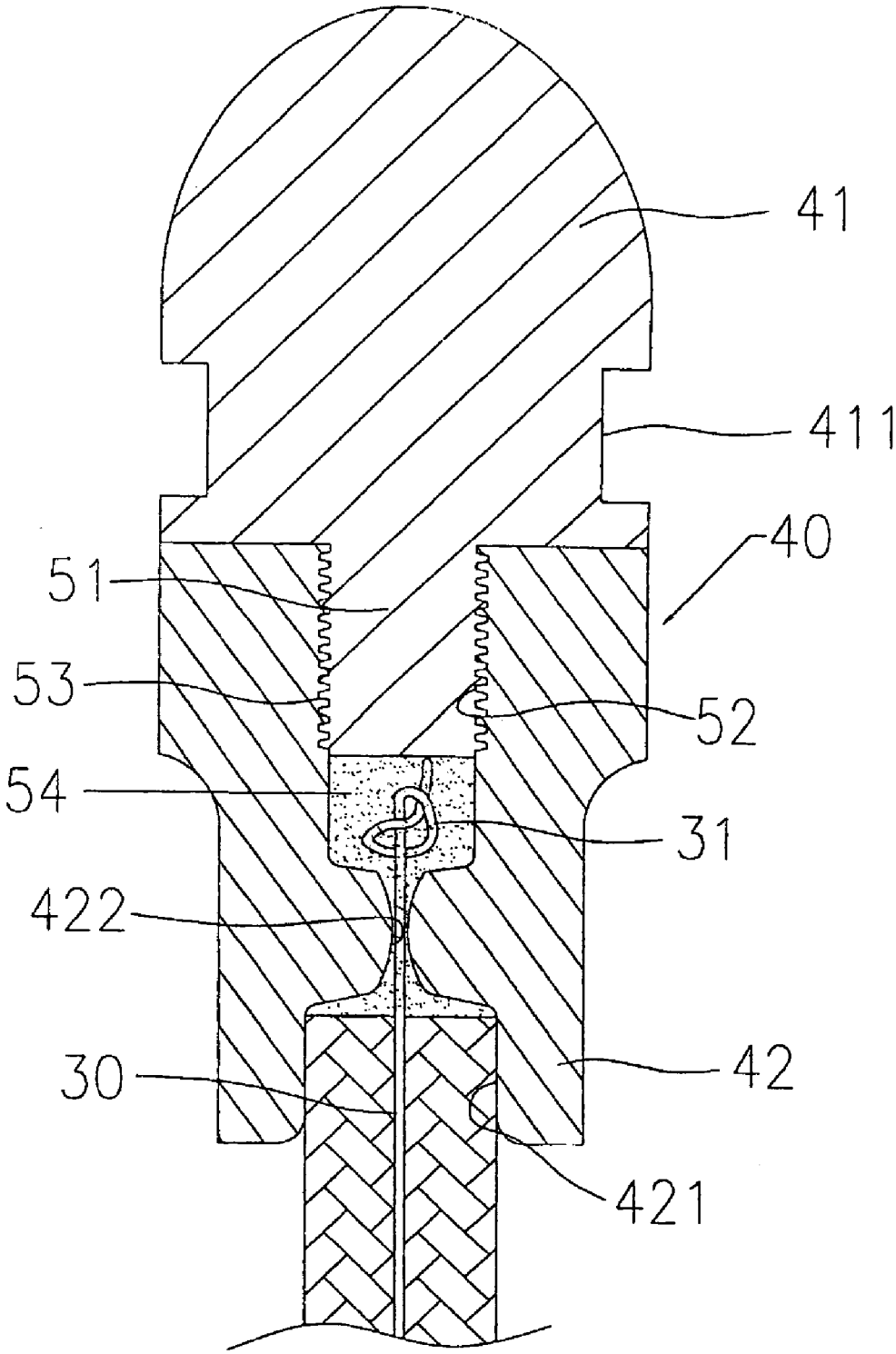
FIG. 7 shows an explosive cross sectional view for illustrating additional details of the screw configuration of the cable attachment fixture of FIG. 6.
Figure 8:
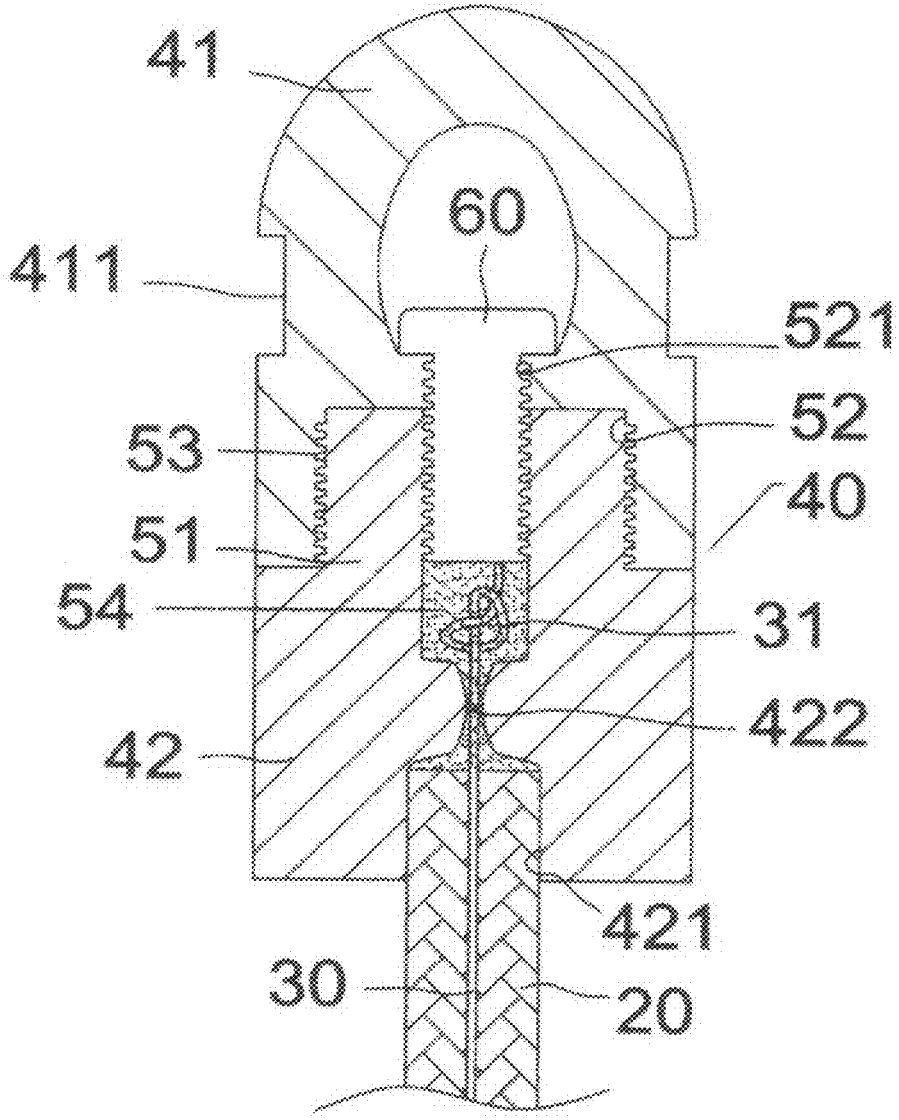
FIG. 8 shows an explosive cross sectional view for illustrating additional details of an alternate screw configuration of the cable attachment fixture of FIG. 6.

FIG. 7 further shows that the structure of the fixture apparatus 40 that includes a front end 41 with a screw rod 51 for securely attaching to the body of the fixture apparatus 40 by screwing onto the walls 52 and 53. An alternate structure is further shown in FIG. 8 where the front end 41 is screwed onto the body of the fixture apparatus 40 through the screws 52 and 53 and a central rod 60 securely attached to the fixture apparatus and pressing onto the epoxy filling the opening for placement of the tie 31 therein. The front end 41 further includes a neck segment 411 for convenience of handling and fixture assembling processes.

Figure 9:
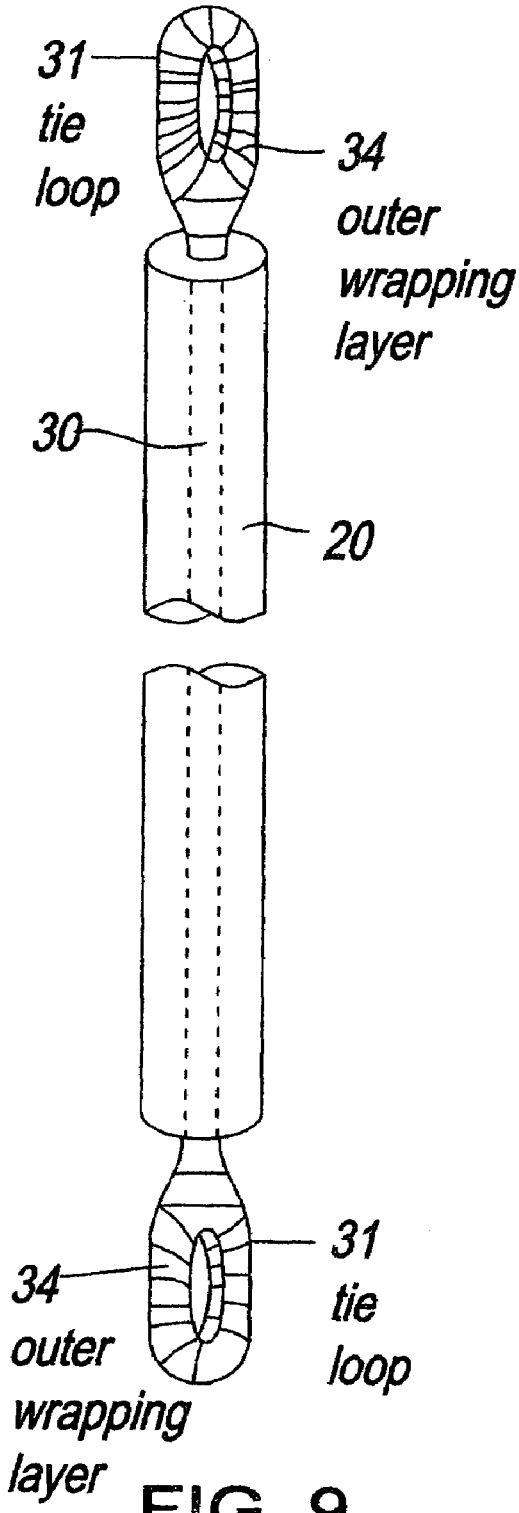
FIGS. 9 and 10 shows alternated embodiments of the cable having two cable loops on both ends to connected the attachment ends of FIG. 8.
Figure 10:
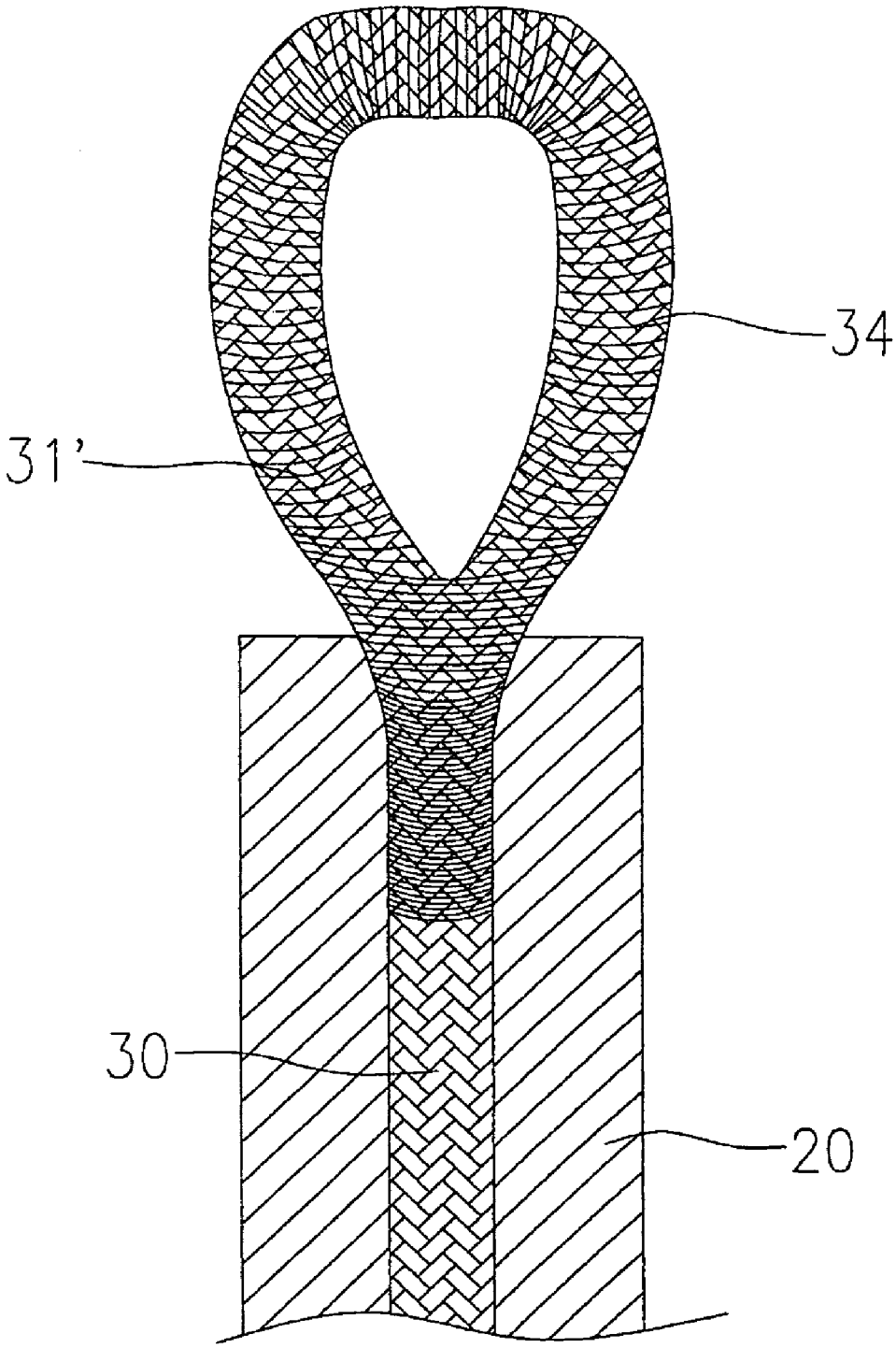
Figure 11:
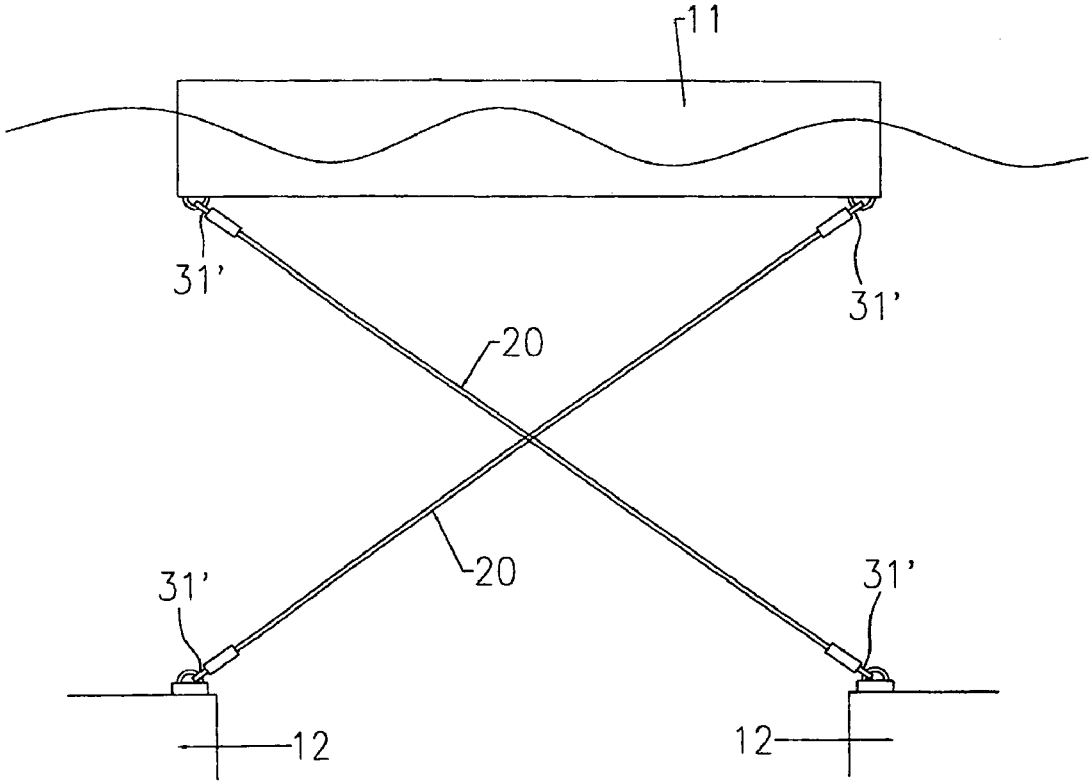
Figure 12:
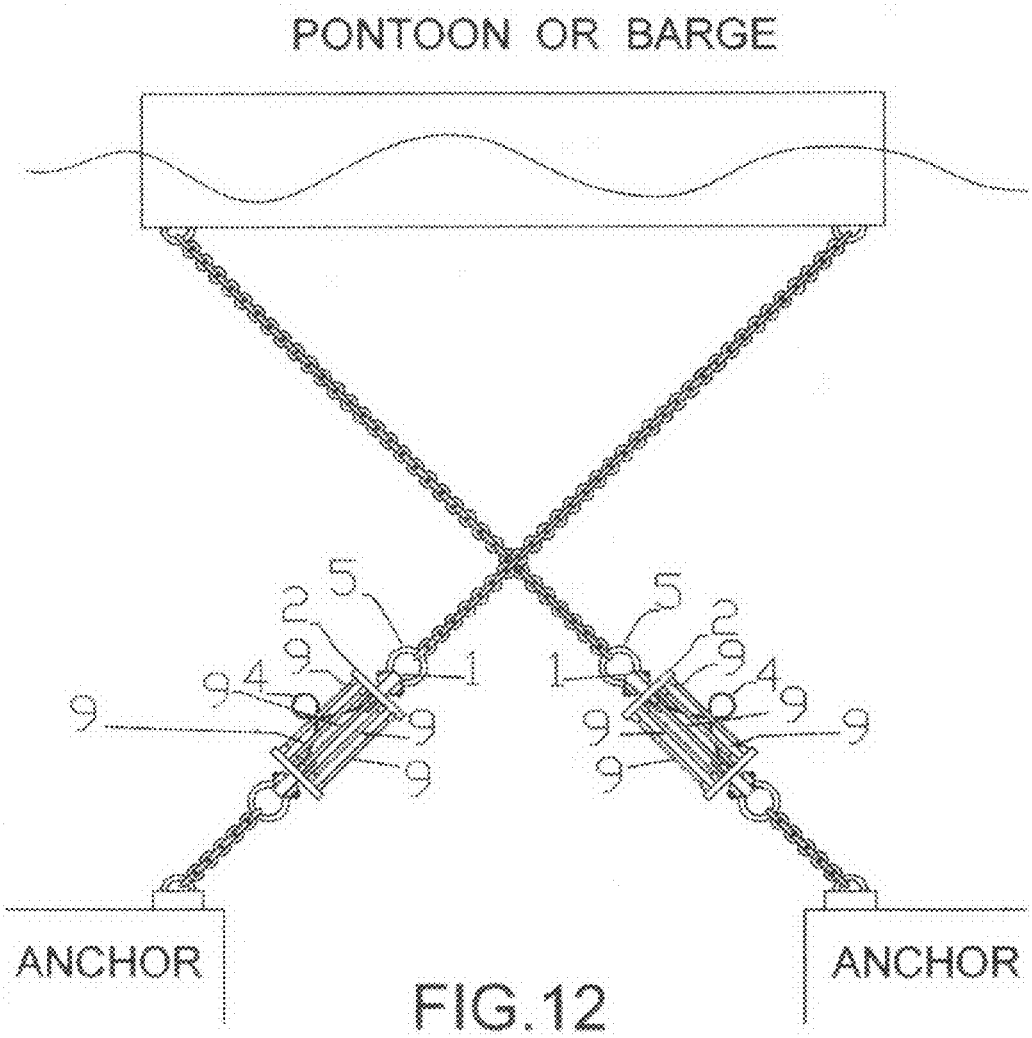
Figure 13:
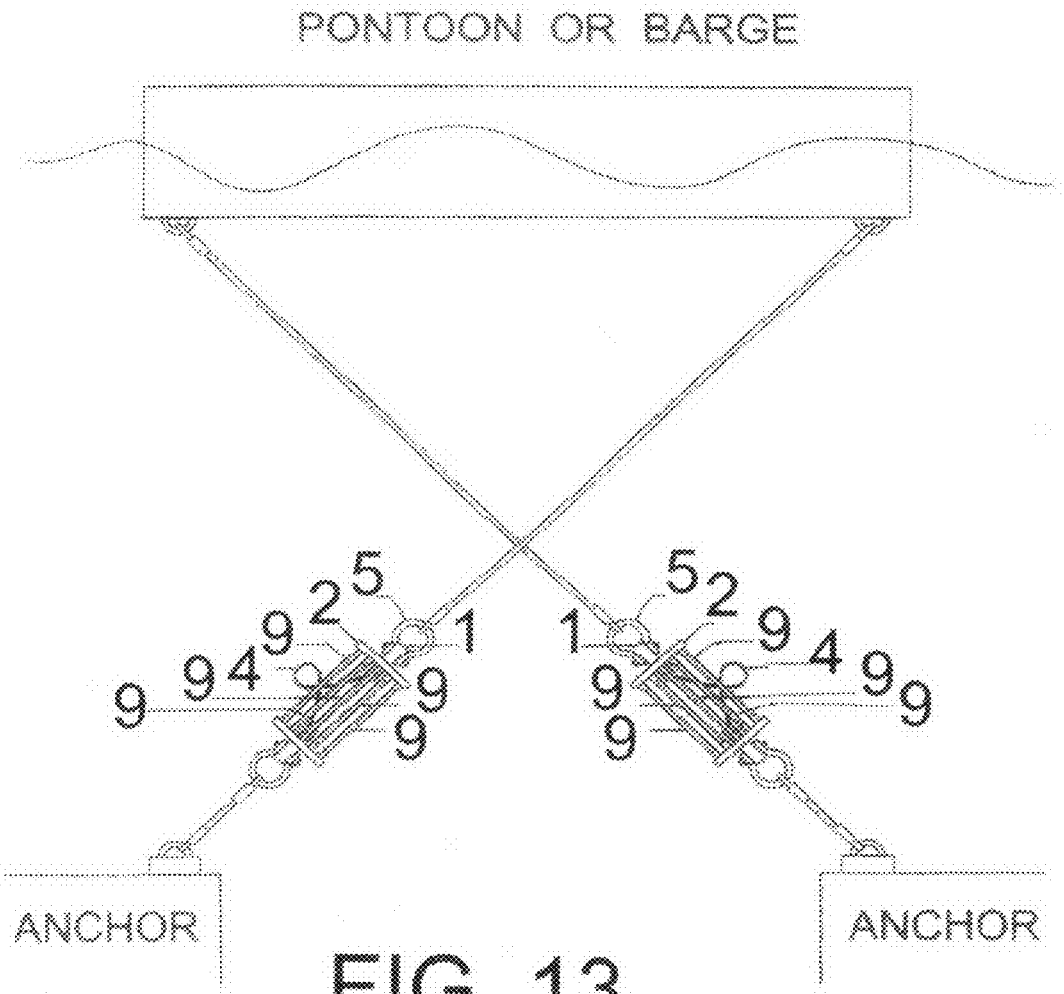

FIGS. 9 and 10 shows alternate exemplary embodiments of the anchoring cables 20 with the core 31 extends out from both end of the cable 20 to form tie-loop 31'. The tie-loops 31 include at least an outer wrapping layer 34 to strengthen the outer surface to sustain tear and pulling force imposed onto the tie-loops 31. The outer wrapping layer 34 may be composed of carbon fiber and or Kelvar fiber or Dyneema fiber wherein the Dyneema fiber is heat processed to up to 110 degrees Celsius to increase the wearing sustainability of the surface. The anchoring cables with the tie-loop 31 are implemented to tie to the anchoring structure 12 as shown in FIG. 11.

The elasticity restoring anchoring cable 20 of this invention therefore comprises multiple layers with some of the layers composed of 20-80% composite rubber and some of the layers composed of 20-80% carbon fiber. The anchoring cables of this invention provide buffering extensions to sustain greater impact force without breaking and allow the cables to restore the elasticity to prevent elasticity fatigue. The elastic buffering flexibility of the cables greatly increases the impact sustainability of the anchoring system because less force are imposed on the interfacing links in the anchoring systems. The elasticity restoring characters of the cable further increases the reliability and the operational lifetime of the anchoring system implemented with this elasticity buffering and restoring cables.

Figure 14H:
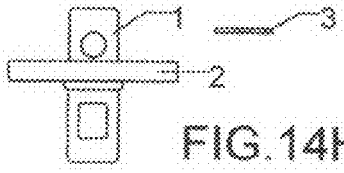
Figure 14G:
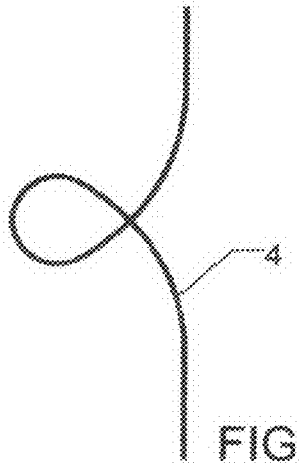
Figure 14F:
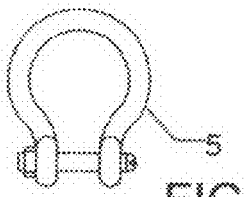
Figure 14E:
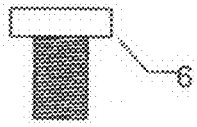
Figure 14D:
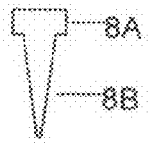
Figure 14C:
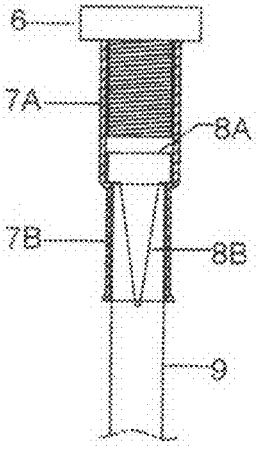
Figure 14B:
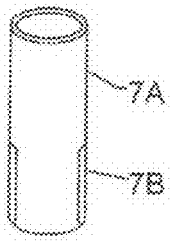
Figure 14A:
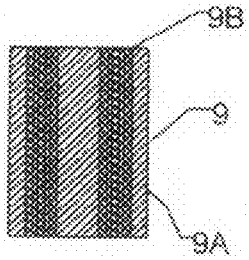
Figure 15:
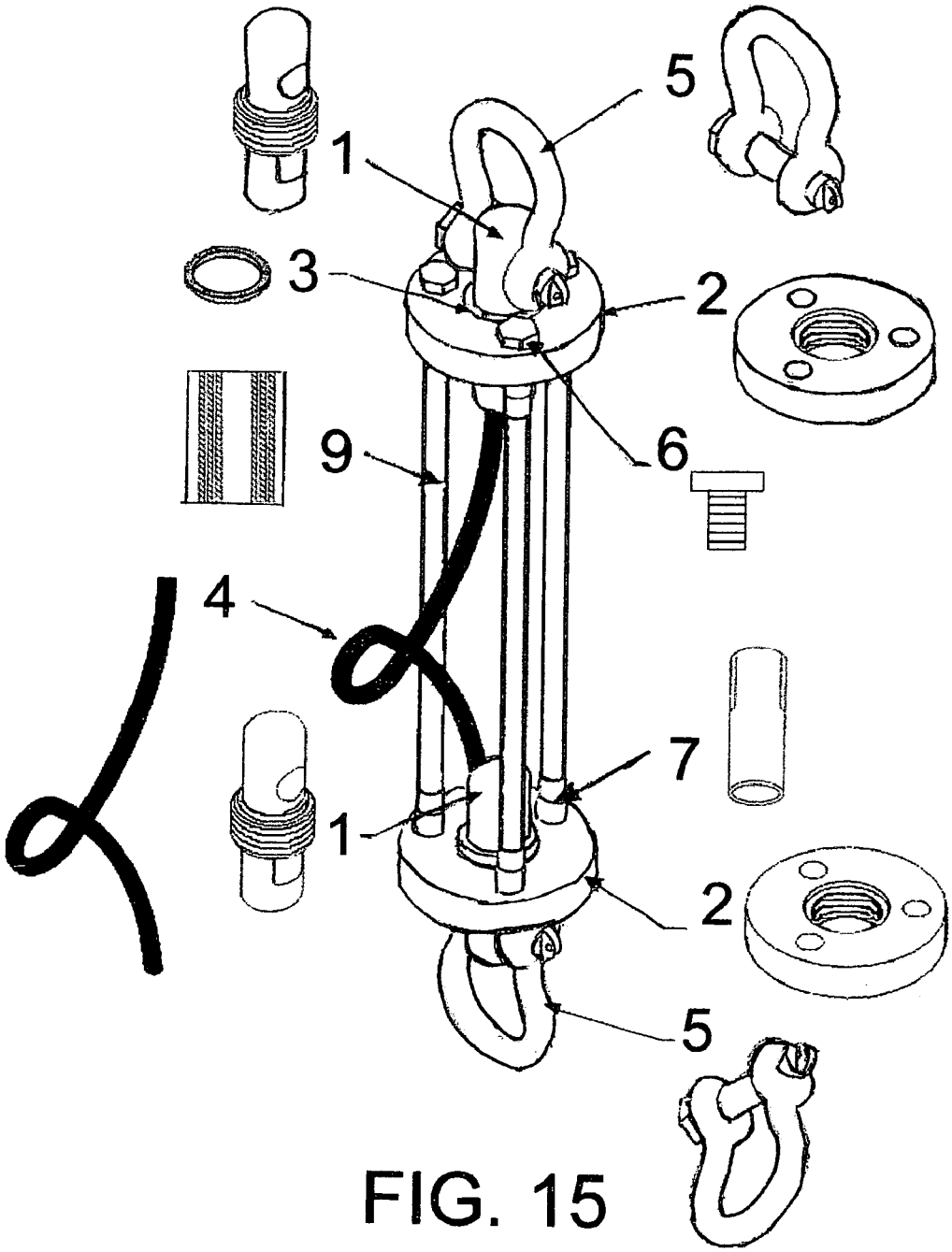
Figure 16:
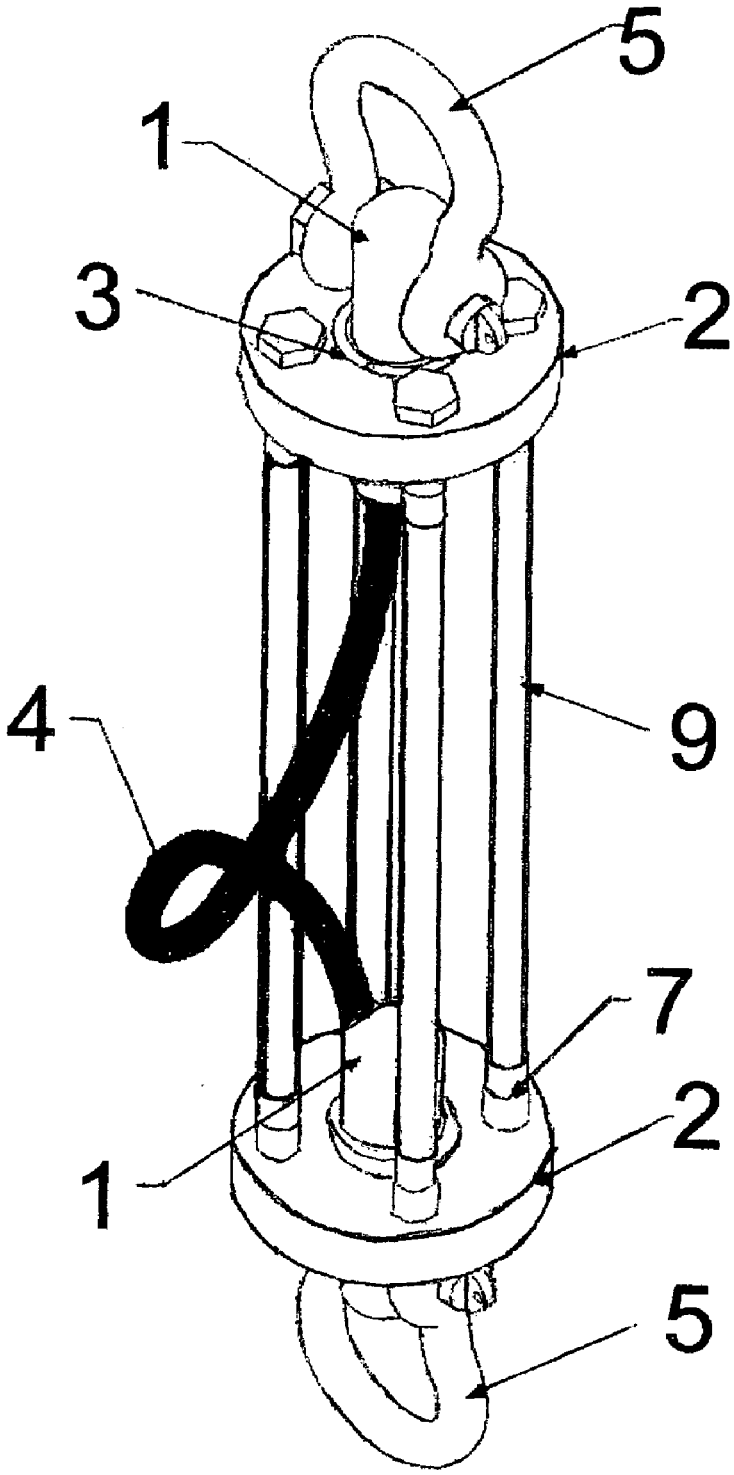
Figure 17:
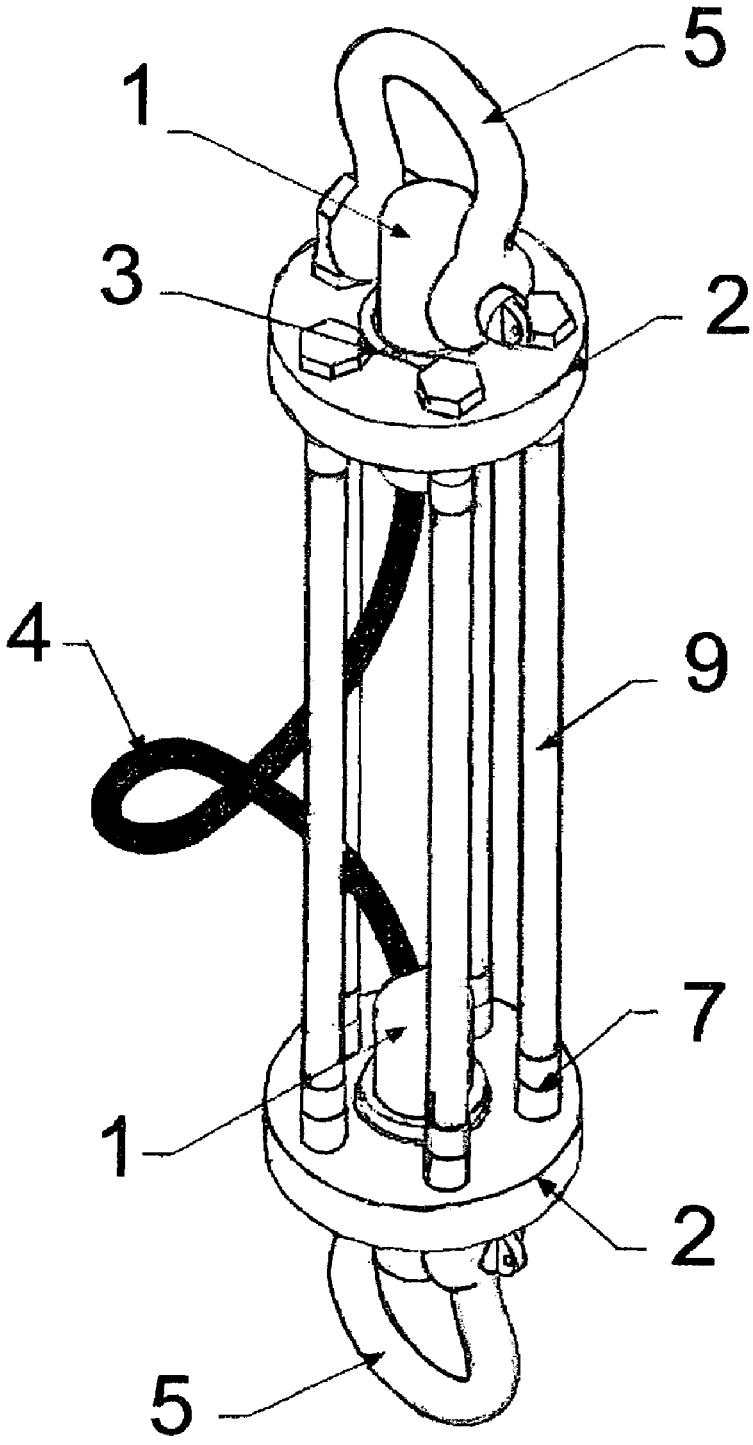
Figure 18:
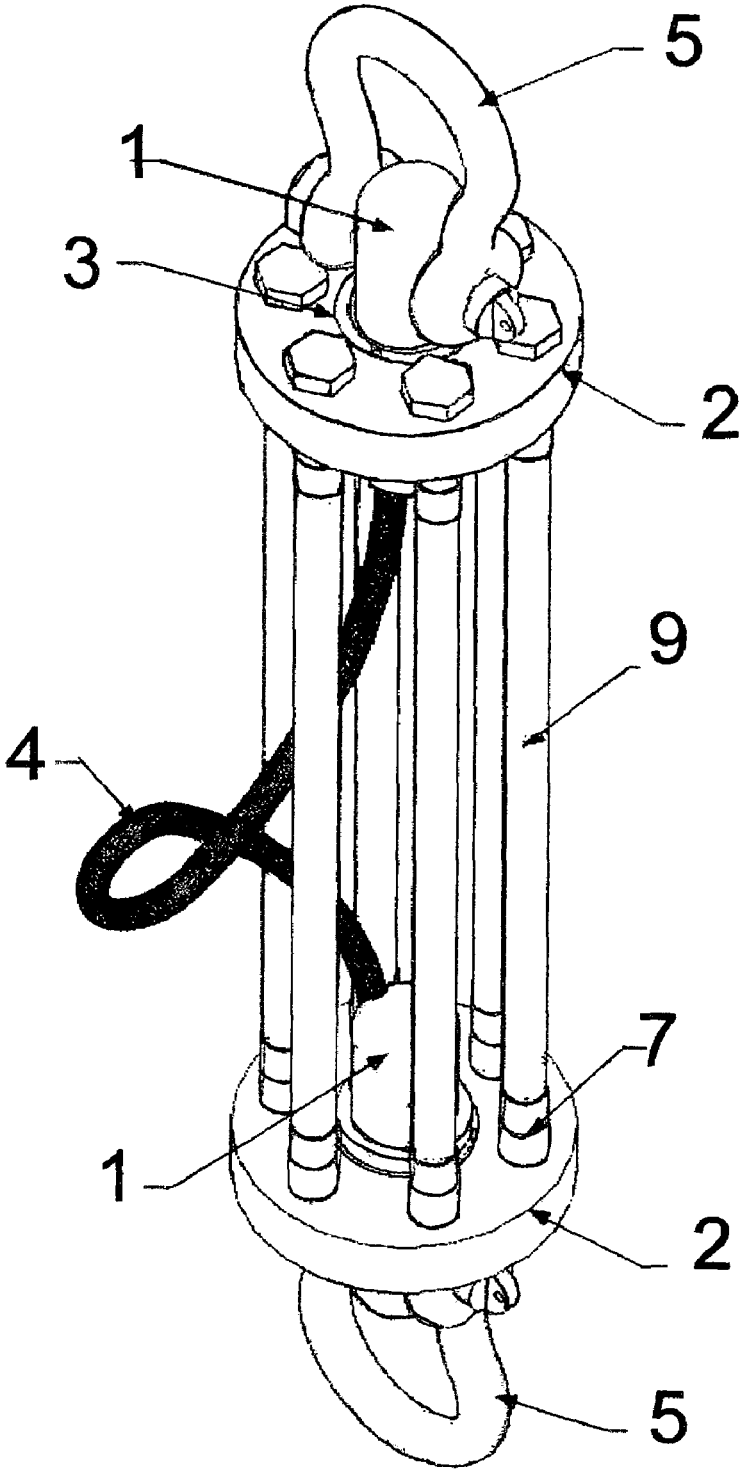
Figure 19:
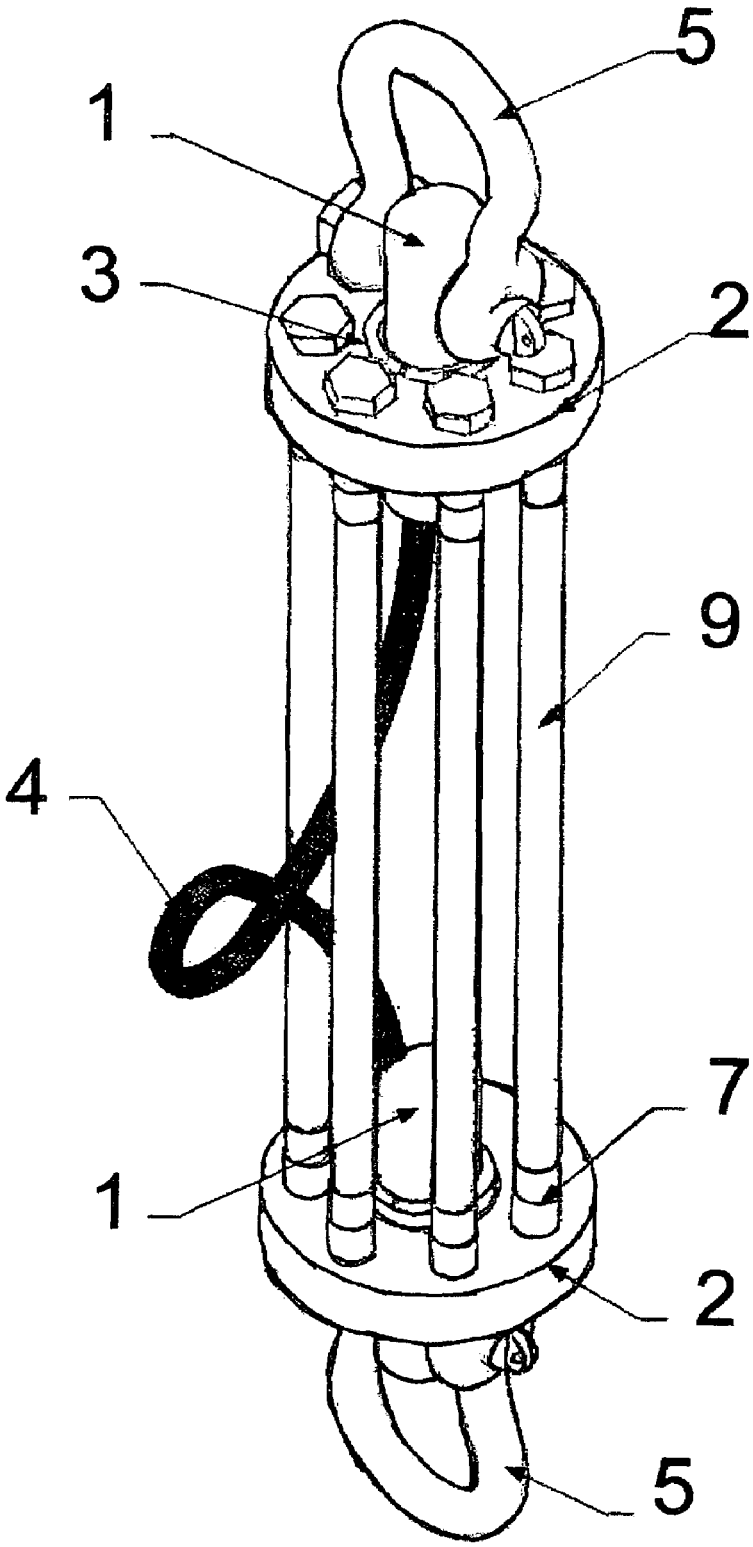
Figure 20:
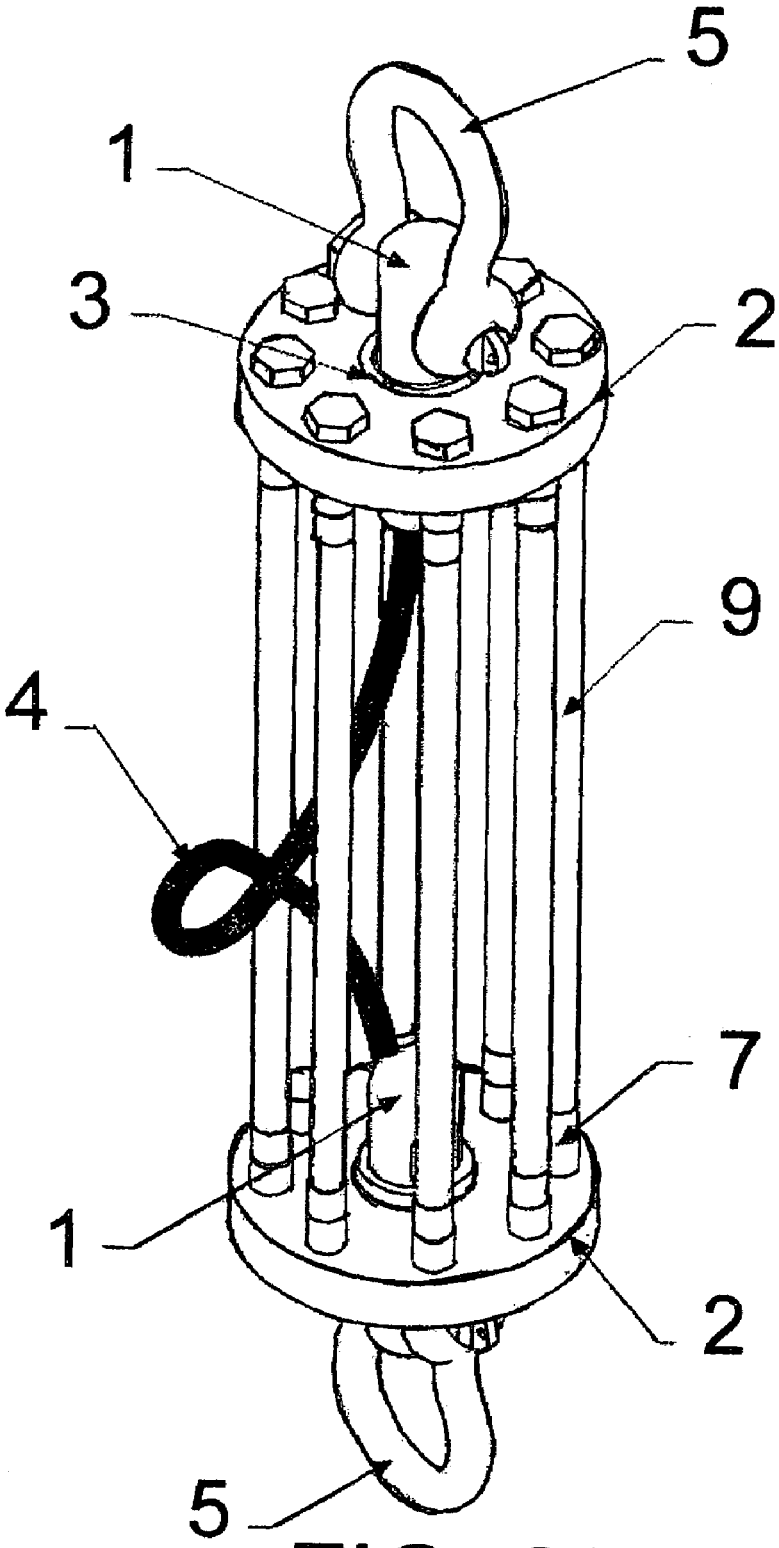
Figure 21:
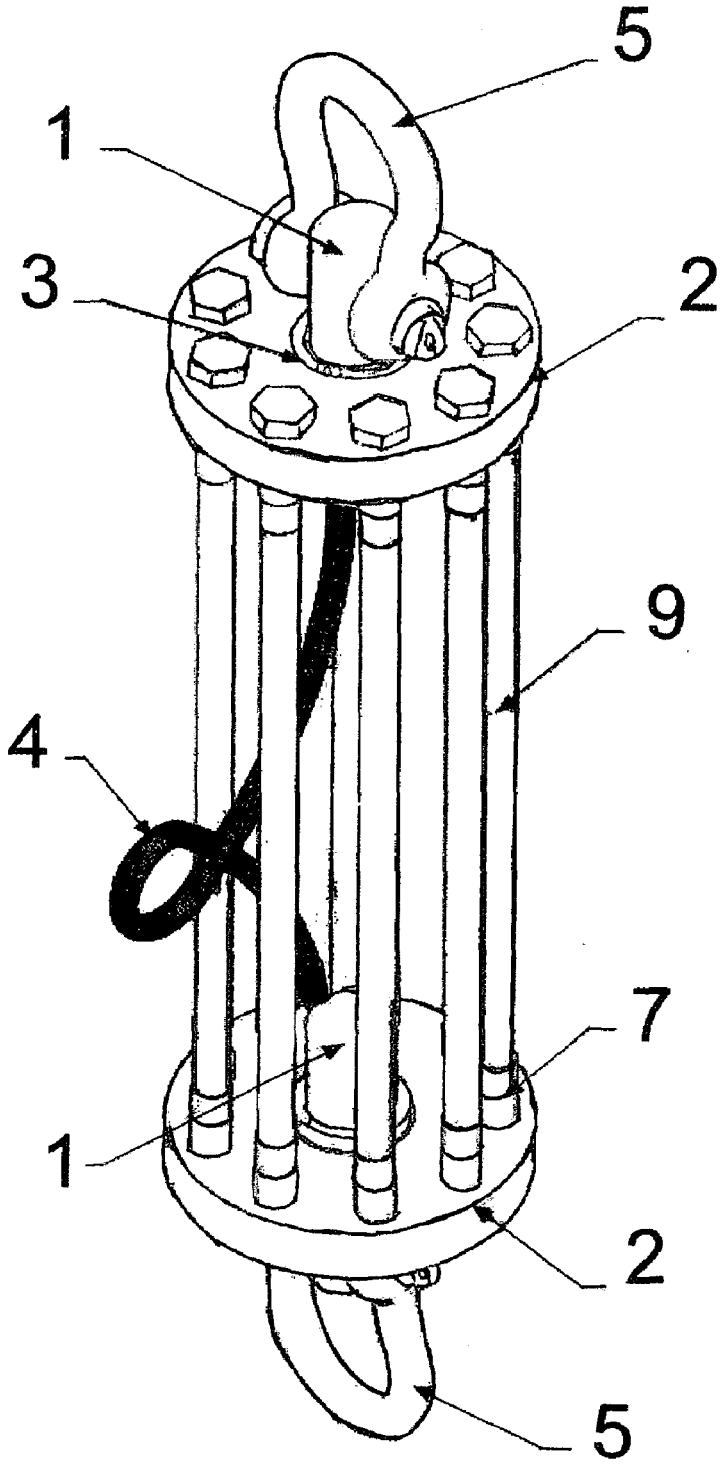
Figure 22:
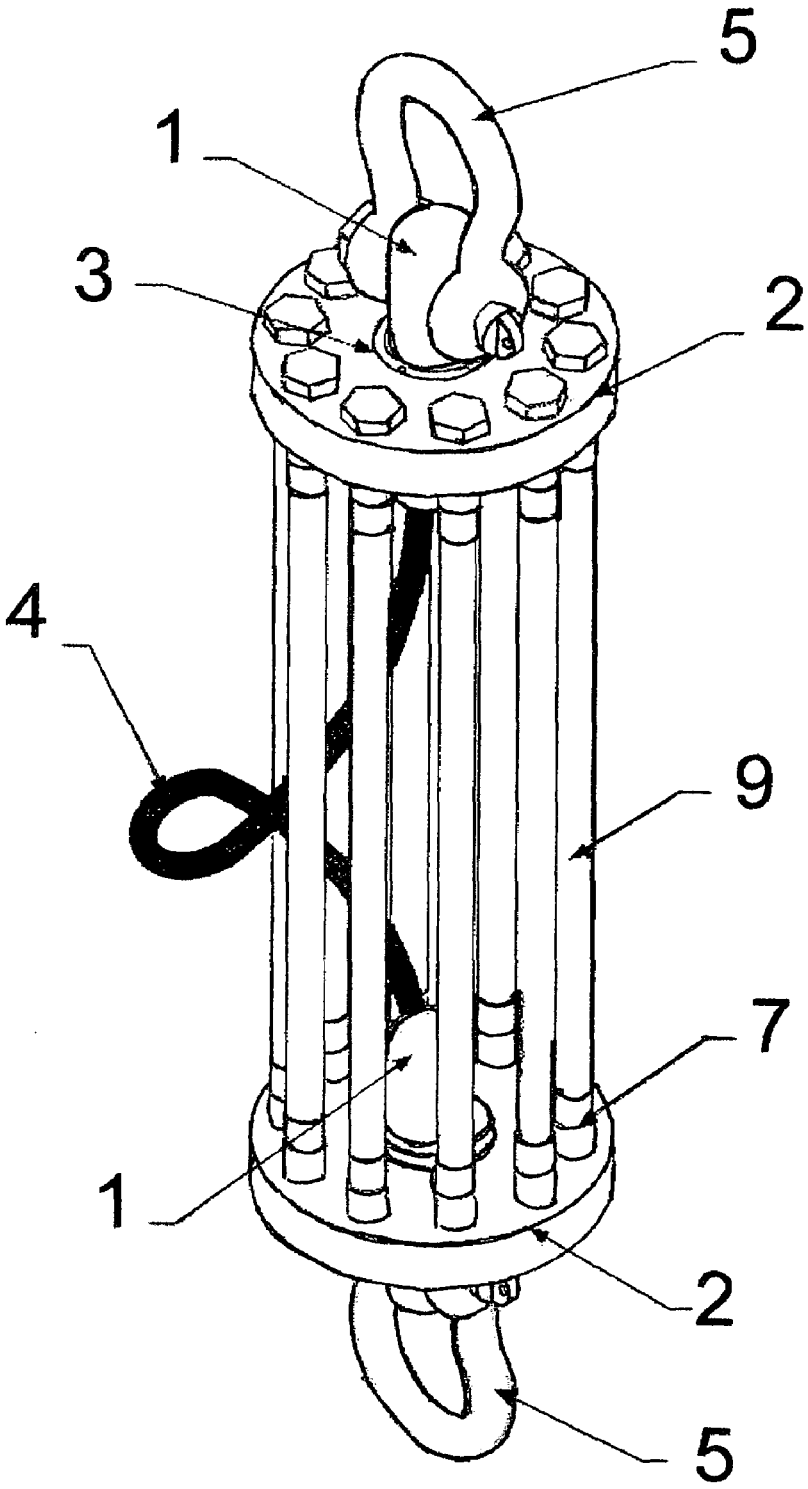
Figure 23:
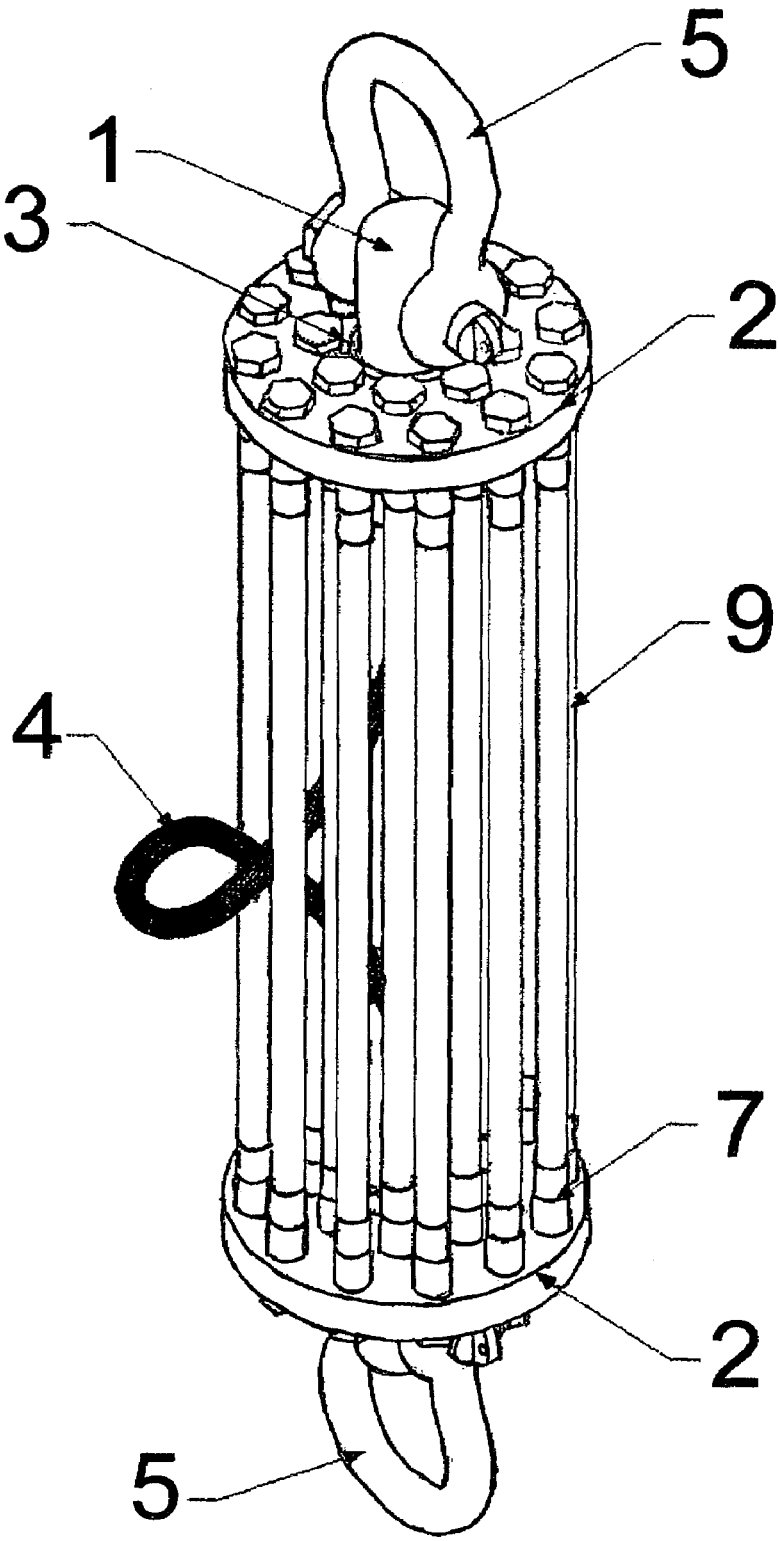
Figure 24:
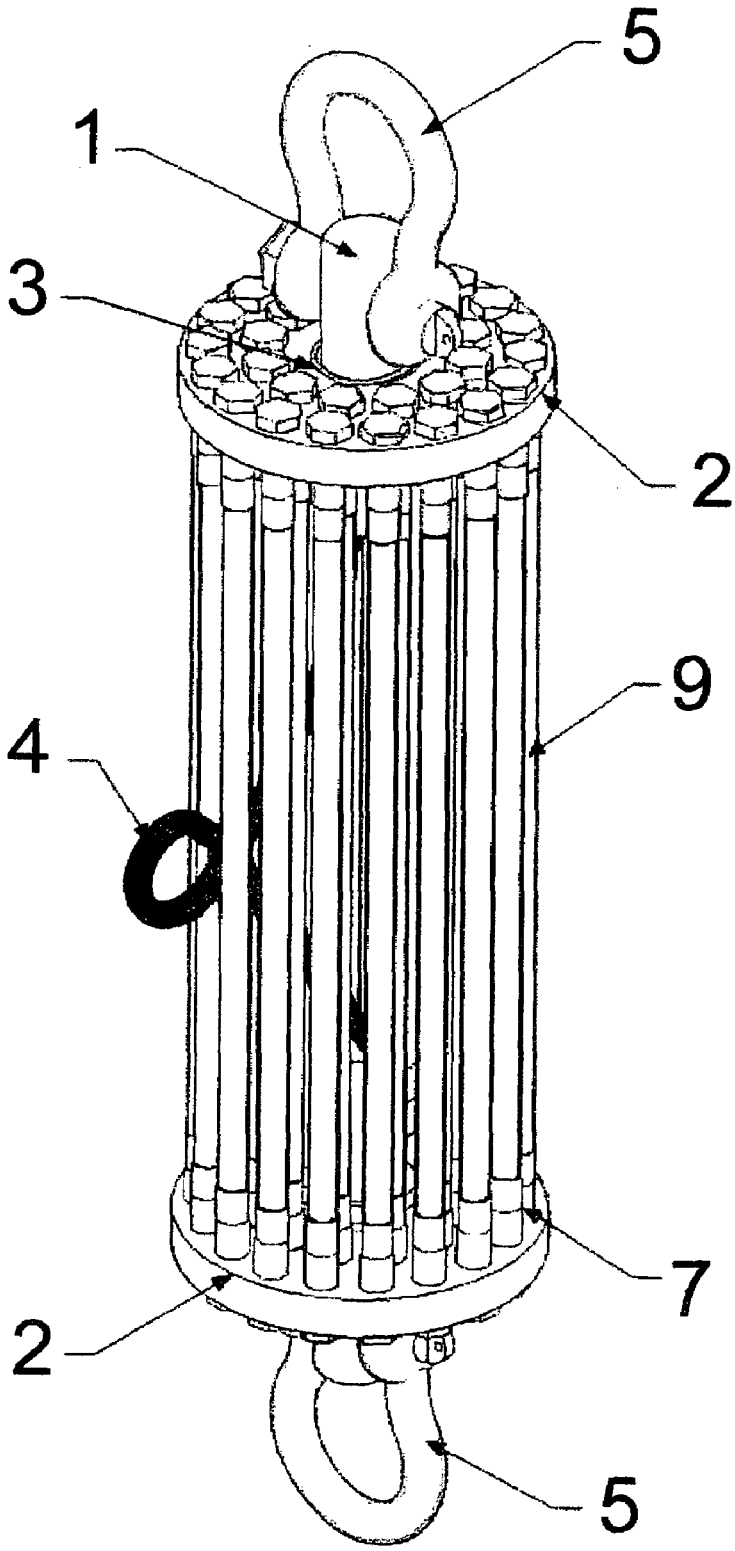

FIGS. 12 to 24 shows alternate embodiments of this invention wherein an elasticity buffering and restoring anchoring link is illustrated. As shown in FIGS. 12 to 24, the cables for holding on to a pontoon or barge to an anchor include a cable extension-locking device. The cable extension-locking device is provided to absorb the sudden shock force and to revive and restore the elasticity after absorbing the shock force while restriction and locking the cable from extension beyond a maximum allowable length. The extension-locking device includes a cable attachment 1 with a structure similar to the attachment end 41 shown in FIG. 1-11. The cable is connected to the attachment ends 1 through interface loops 5 (FIG. 14F). The extension-locking device includes two endplates attached to the end attachment 1. The endplates 2 securely adapt and screwed onto a plurality of rubber ropes 9 and a safety-locking loop 4 between these two end plates 2. The rubber ropes 9 include rubber portion 9A and fiber portion 9B for allowing the extension-locking device to extend when impact by a shock force. The safety-locking loop 4 restricts the extension of the extension-locking device to a certain distance. FIG. 14A to FIG. 14H show the details of the rubber ropes 9 (FIG. 14A) securely fixed onto the endplates 2 (FIG. 14H) with screws 6 (FIG. 14E) and screw sleeves and secure-pins 8A and 8B (FIG. 14D) enclosed in a sleeve includes a tip sleeve 7A and a narrower sleeve 7B (FIG. 14B). The safety-locking loop 4 (FIG. 14G) is composed of Kelvar fiber or Dyneema fiber that restricts the extension of the extension-locking device while the rubber ropes 9 (FIG. 14A) are shorter and extendable when pulled by a force and extend to a length substantially equal to a length of the safety-locking loop 4 (FIG. 14G). An anchoring cable is therefore disclosed that is able to immediately absorb an impacting force with buffering and extension capability right after a force is imposed thereon. Furthermore, the anchoring cable has a predefined controllable length of extension with the extension-locking device that limit the extension to certain distance. The anchoring cable further has a predefined and controllable capability to absorb a specified pulling force. This force absorption capacity can be designed with predefined amount of pulling force expected to assert onto the anchoring cable and the extension-locking device. By designing the anchoring cable with a force absorption capacity greater than the expected pulling force, an offshore platform can be securely and reliably maintain within a certain fixed areas because the anchoring is designed to handle the maximum pulling force with a maximum length extension according to the design and configuration as disclosed in this invention.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

I claim:

1. A floating structure anchoring system comprising:

an anchoring cable having an extension-lock device including rubber ropes to allow for stretching longer to absorb pulling force asserted thereon and a safety-locking loop having a longer length than said rubber ropes for restricting an extended length of the extension-lock device whereby a sudden pulling force is absorbed by the rubber ropes and a distance of movement from said sudden pulling force is restricted by said safety-locking loop.

* * * * *